US009121408B2

(12) United States Patent
Shioda et al.

(10) Patent No.: US 9,121,408 B2
(45) Date of Patent: Sep. 1, 2015

(54) CENTRIFUGAL COMPRESSOR

(75) Inventors: Jumpei Shioda, Susono (JP); Masakazu Tabata, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/005,124

(22) PCT Filed: Mar. 23, 2011

(86) PCT No.: PCT/JP2011/057052
§ 371 (c)(1),
(2), (4) Date: Sep. 13, 2013

(87) PCT Pub. No.: WO2012/127667
PCT Pub. Date: Sep. 27, 2012

(65) Prior Publication Data

US 2014/0003930 A1 Jan. 2, 2014

(51) Int. Cl.
*F04D 29/46* (2006.01)
*F04D 17/08* (2006.01)
*F04D 27/02* (2006.01)
(Continued)

(52) U.S. Cl.
CPC ..... *F04D 17/08* (2013.01); *F04D 27/0246* (2013.01); *F04D 29/444* (2013.01); *F04D 29/462* (2013.01); *F04D 29/464* (2013.01); *F04D 29/701* (2013.01)

(58) Field of Classification Search
CPC ..... F04D 29/46; F04D 29/466; F04D 29/468
USPC ..... 415/126, 211.2
See application file for complete search history.

(56) References Cited

U.S. PATENT DOCUMENTS 4,503,684 A 3/1985 Mount et al.
5,683,223 A * 11/1997 Harada et al. ..... 415/17
6,036,432 A * 3/2000 Sishtla et al. ..... 415/26
(Continued)

FOREIGN PATENT DOCUMENTS

JP 04-043899 2/1992
JP 04-143499 5/1992
(Continued)

OTHER PUBLICATIONS

International Search Report Issued Jul. 5, 2011 in PCT/JP11/57052 Filed Mar. 23, 2011.
(Continued)

*Primary Examiner* — Ninh H Nguyen
(74) *Attorney, Agent, or Firm* — Oblon, McClelland, Maier & Neustadt, L.L.P.

(57) ABSTRACT

A compressor has a hub-side wall of a hub-side wall plate, a shroud-side wall that faces the hub-side wall and forms a diffuser path between the shroud-side wall and the hub-side wall, vanes that protrude from the hub-side wall plate into the diffuser path, and an actuator capable of changing the distance between the vanes and the shroud-side wall in accordance with a flow rate of air in the diffuser path. Adjacent ones of the adjacent vanes do not overlap with each other when viewed from a center axis of the compressor. When the actuator maximizes the distance between the vanes and the shroud-side wall, the distance between the vanes and the shroud-side wall is smaller than the distance between the hub-side wall and areas of the shroud-side wall that face the vanes.

4 Claims, 10 Drawing Sheets

(51) Int. Cl.
*F04D 29/44* (2006.01)
*F04D 29/70* (2006.01)

(56) References Cited

U.S. PATENT DOCUMENTS

| | | | | |
|---|---|---|---|---|
| 6,872,050 | B2 * | 3/2005 | Nenstiel | 415/151 |
| 8,567,207 | B2 * | 10/2013 | Sommer et al. | 62/228.1 |
| 2008/0170938 | A1 | 7/2008 | Shinohara | |

FOREIGN PATENT DOCUMENTS

| | | |
|---|---|---|
| JP | 2000 205186 | 7/2000 |
| JP | 2008 169801 | 7/2008 |

OTHER PUBLICATIONS

Office Action issued Nov. 2, 2014 in Chinese Patent Application No. 201180069352.7.

* cited by examiner

CENTRIFUGAL COMPRESSOR

TECHNICAL FIELD

The present invention relates to centrifugal compressors.

BACKGROUND ART

Conventionally, there is known a centrifugal compressor in which guide blades (vanes) that are arranged between an impeller and a scroll and are provided in a diffuser flow path, the vanes decreasing and pressurizing a fluid having a speed increased by the impeller.

For example, Patent Document 1 describes an invention that controls the positions of vanes in accordance with the flow rate of air in a diffuser flow path (airflow rate). For example, the vanes protrude into the diffuser flow path for low airflow rates, and do not protrude into the diffuser flow path for high airflow rates.

PRIOR ART DOCUMENTS

Patent Documents

Patent Document 1: Japanese Patent Application Publication No. 2000-205186

SUMMARY OF THE INVENTION

Problems to be Solved by the Invention

As an actuator for moving the vanes, there are a diaphragm type actuator and a solenoid type actuator. The diaphragm type actuator moves the vanes by using negative pressure. The solenoid type actuator is structured to arrange an iron core in a coil and to move the vanes by an electromagnetic force generated when a current flows through the coil.

Since the movement distance of the vanes is large in the conventional art, an external actuator of diaphragm type attached to an outside portion of a housing may be used. However, the use of the external actuator of diaphragm type increases the size of the centrifugal compressor. The use of the solenoid type actuator may have a possibility of increasing the power consumption. The present invention takes the above into account, and aims at providing a centrifugal compressor in which downsizing and reduction in the power consumption are feasible.

Means for Solving the Problems

The present invention is a centrifugal compressor comprising: a first diffuser wall; a second diffuser wall that faces the first diffuser wall and forms a diffuser flow path between the first diffuser wall and the second diffuser wall; guide blades capable of protruding from the first diffuser wall into the diffuser flow path; and change means capable of changing a distance between the guide blades and the second diffuser wall in accordance with an airflow rate of the diffuser flow path, wherein the centrifugal compressor is equipped with at least one of a structure in which adjacent ones of the guide blades do not overlap with each other when viewed from a center axis of the centrifugal compressor and a structure in which a throat is not formed between adjacent ones of the guide blades; and a distance between the guide blades and the second diffuser wall is smaller than a distance between the first diffuser wall and areas of the second diffuser walls that face the guide blades when the change means maximizes the distance between the guide blades and the second diffuser wall. According to the present invention, it is possible to downsize the compressor and reduce the power consumption.

In the above structures, a chord-pitch ratio of the guide blades may be equal to or smaller than 1 With this structure, it is possible to efficiently obtain high compression efficiency.

In the above structures, the change means may be an electric actuator. With this structure, it is possible to efficiently realize downsizing and reduction in power consumption.

In the above structures, the change means may be a solenoid type actuator. With this structure, it is possible to efficiently realize downsizing and reduction in power consumption.

In the above structures, the change means may set the distance between the guide blades and the second diffuser wall to a first distance if the airflow rate of the diffuser flow path is equal to or larger than a predetermined value; and the change means may set the distance between the guide blades and the second diffuser wall to a distance smaller than the first distance if the airflow rate of the diffuser flow path is equal to or smaller than the predetermined value. With this structure, it is possible to realize high compression efficiency in both cases of low airflow rates and high airflow rates.

In the above structures, the change means may change the distance between the guide blades and the second diffuser wall from the first distance, and then returns the distance to the first distance, if a state in which the airflow rate is equal to or larger than the predetermined value continues for a predetermined time. With this structure, it is possible to smoothen the operation of the guide blades.

In the above structures, the change means may set the distance between the guide blades and the second diffuser wall larger than the first distance, and then returns the distance to the first distance, if the state in which the airflow rate is equal to or larger than the predetermined value continues for a predetermined time. With this structure, it is possible to maintain high compression efficiency and smoothen the operation of the guide blades.

Effects of the Invention

According to the present invention, with the above problems in mind, it is possible to provide a centrifugal compressor in which downsizing and reduction in the power consumption are feasible.

BEST MODES FOR CARRYING OUT THE INVENTION

Embodiment 1

Figure 1:
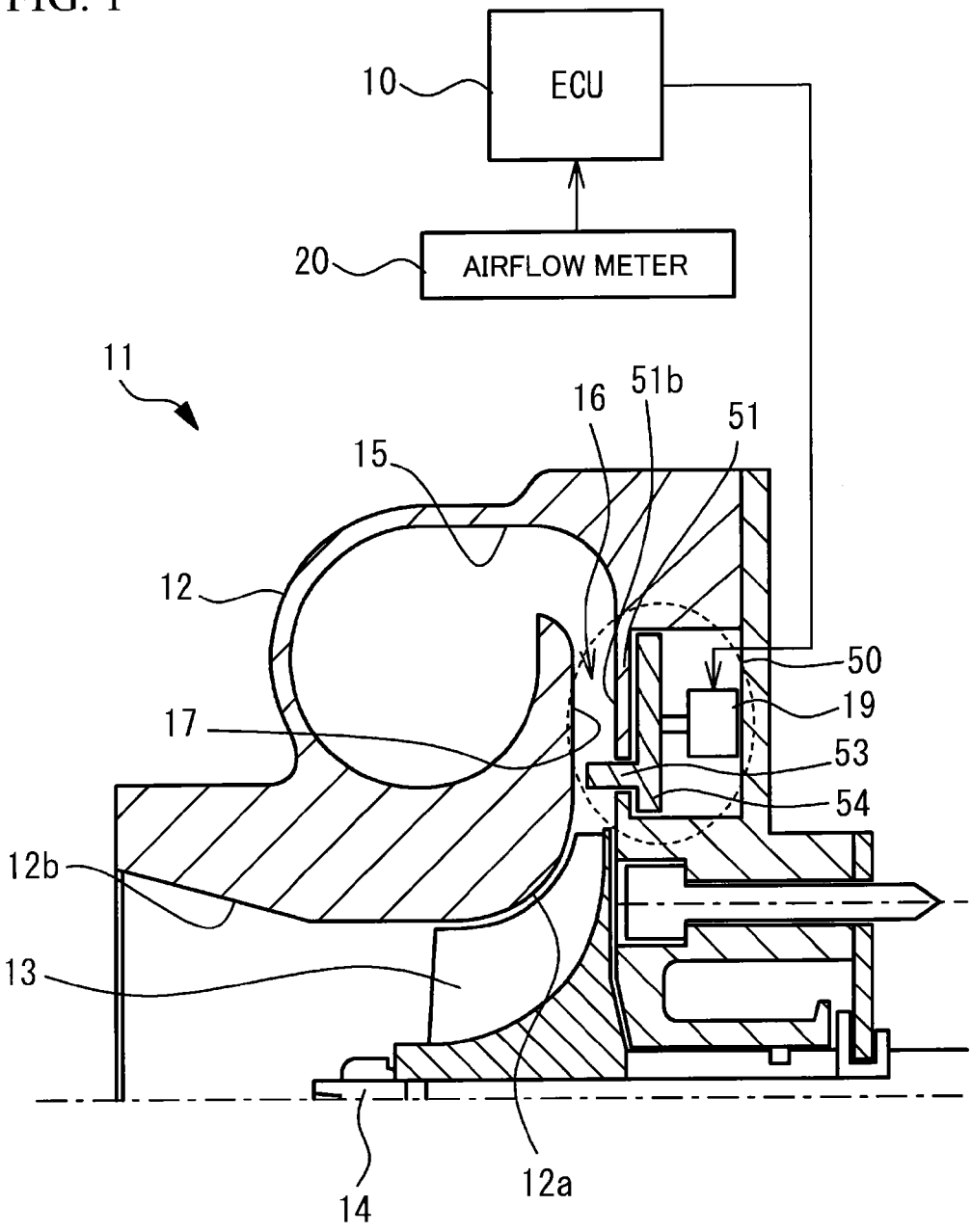
FIG. 1 is a cross-sectional view that illustrates an outline of an exemplary compressor in accordance with Embodiment 1.

FIG. 1 is a cross-sectional view that illustrates an outline of an exemplary compressor in accordance with Embodiment 1. As depicted in FIG. 1, a compressor 11 (centrifugal compressor) in accordance with Embodiment 1 is equipped with a compressor housing 12, an impeller 13, a shaft 14, an actuator 19 (change means), an airflow meter 20, and a slide type vane mechanism 50.

The compressor housing 12 is a housing of the compressor 11. The compressor housing 12 is equipped with an impeller accommodating portion 12*a*. The impeller 13 is accommodated in the impeller accommodating portion 12*a*. The impeller 13 is rotated by the shaft 14. The shaft 14 may be joined to a turbine, for example. That is, the compressor 11 may be used for a turbosupercharger, for example.

Figure 2:
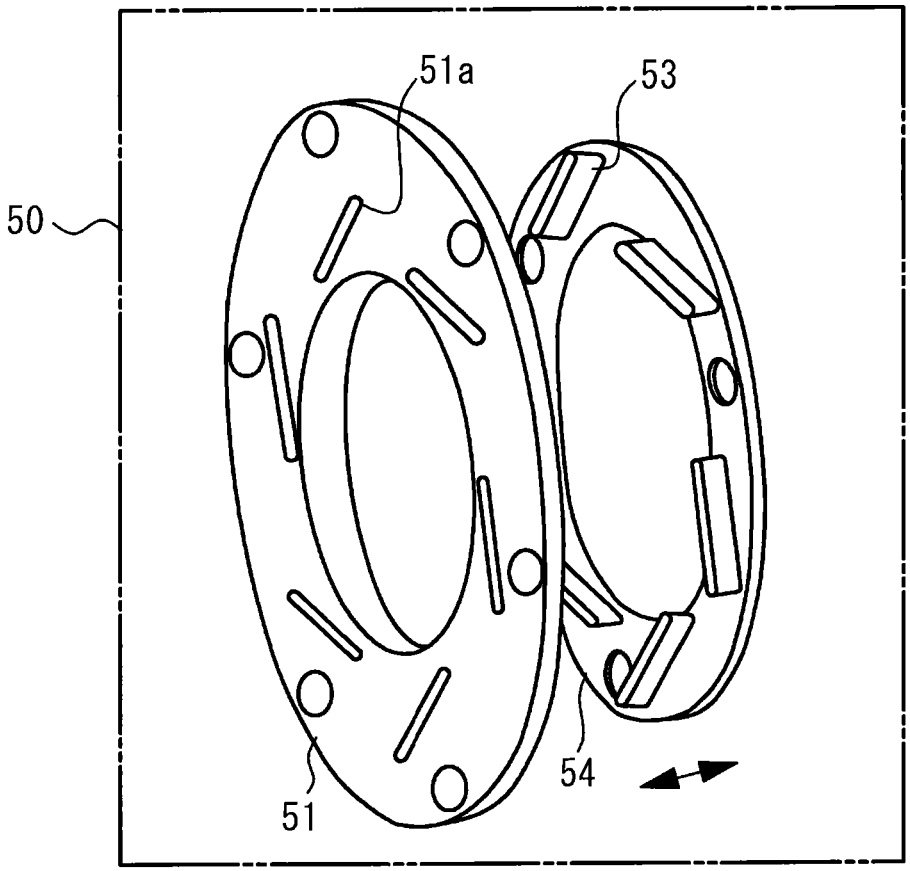
FIG. 2 is an exploded structural view of a slide type vane mechanism.

A fluid is sucked in the compressor housing 12 from an air inlet 12*b*. The sucked fluid flows toward the impeller 13 and is discharged toward the outside by the rotation of the impeller 13. A scroll portion 15 is provided at the outside of the impeller 13. The fluid discharged toward the outside by the impeller 13 is supplied to, for example, an intake manifold of an engine via the scroll portion 15. A diffuser portion 16 having a diffuser flow path is provided between the impeller 13 and the scroll portion 15. The diffuser portion 16 is adjacently provided around the impeller 13. The diffuser portion 16 converts kinetic energy of the fluid discharged by the impeller 13 to pressure. Now, the slide type vane mechanism 50 is described. FIG. 2 is an exploded structural view of the slide type vane mechanism.

As depicted in FIG. 2, the slide type vane mechanism 50 is equipped with a hub-side wall plate 51 and vanes 53. A hub-side wall 51*b* (first diffuser wall) of the hub-side wall plate 51 and a shroud-side wall 17 (second diffuse wall) depicted in FIG. 1 face each other to form a diffuser flow path.

The diffuser plate 54 has six vanes 53, for example. The vanes 53 are arranged so that end surfaces face the shroud-side wall 17 and the longitudinal directions of guide blades are at a predetermined angle with respect to the direction of the shaft 14 of the impeller 13. In this arrangement, the vanes 53 may have a structure in which the angles of the guide blades may be changed by employing a pivot mechanism or the like. The vanes 53 are a structural example of the guide blades of the present invention.

The hub-side wall plate 51 has six slits 51*a*, for example. The slits 51*a* are through holes having a shape similar to that of the vanes 53. The slits 51*a* are provided so as to correspond to the vanes 53 and enable the vanes 53 to protrude into the diffuser flow path. When the diffuser plate 54 moves in the directions of arrows in FIG. 2, the amount of protrusion of the vanes 53 is changed. The slide type vane mechanism 50 is assembled to the compressor housing 12 so that the side depicted in FIG. 2 faces the shroud-side wall 17 depicted in FIG. 1.

When the actuator 19 depicted in FIG. 1 drives the diffuser plate 54, the amount of protrusion of the vanes 53 into the diffuser flow path is changed. In other words, the actuator 19 changes the distance between the vanes 53 and the shroud-side wall 17. The actuator 19 is a solenoid type actuator, for example. The ECU 10 controls the actuator 19. For example, the ECU 10 controls power supplied to the coil of the actuator 19, and controls the force applied to the diffuser plate 54 by the actuator 19. The airflow meter 20 is capable of measuring the flow rate of air (airflow rate) that flows through the diffuser flow path. The ECU 10 obtains the airflow rate measured by the airflow meter 20, and controls the actuator 19 on the basis of the airflow rate.

When the airflow rate of the diffuser flow path is low (low airflow rates), the degree of protrusion of the vanes 53 into the diffuser path is increased, in other words, the distance between the vanes 53 and the shroud-side wall 17 is decreased, so that the compression efficiency of the compressor 11 can be increased. When the airflow rate of the diffuser flow path is high (high airflow rates), the degree of protrusion of the vanes 53 is decreased, in other words, the distance between the vanes 53 and the shroud-side wall 17 is increased, so that the hitting loss of the air to the vanes 53 can be reduced and therefore the compression efficiency can be increased.

Figure 3A:
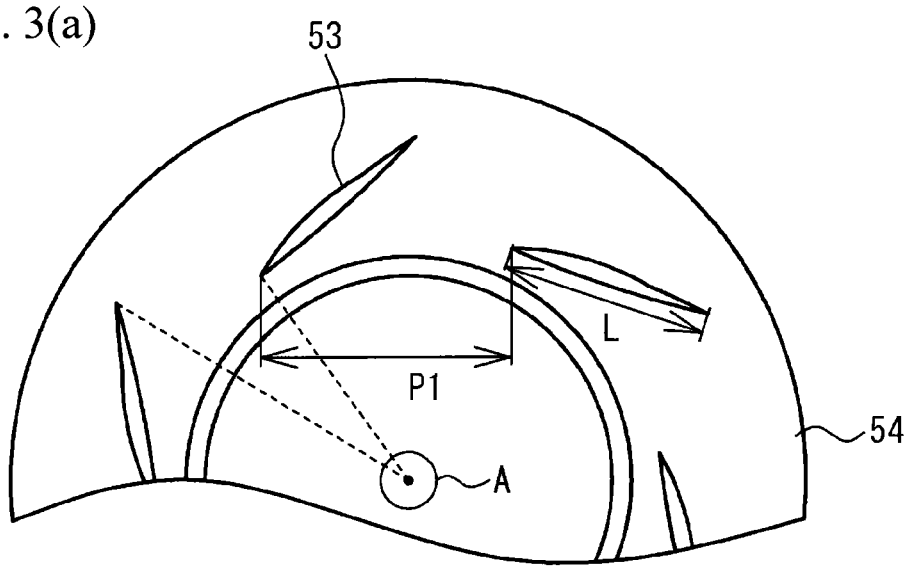
FIG. 3(*a*) is a front view that illustrates an exemplary diffuser plate with which the compressor is equipped in accordance with Embodiment 1, and FIG. 3(*b*) is a front view that illustrates an exemplary diffuser plate with which a compressor is equipped in accordance with Comparative Example.
Figure 3B:
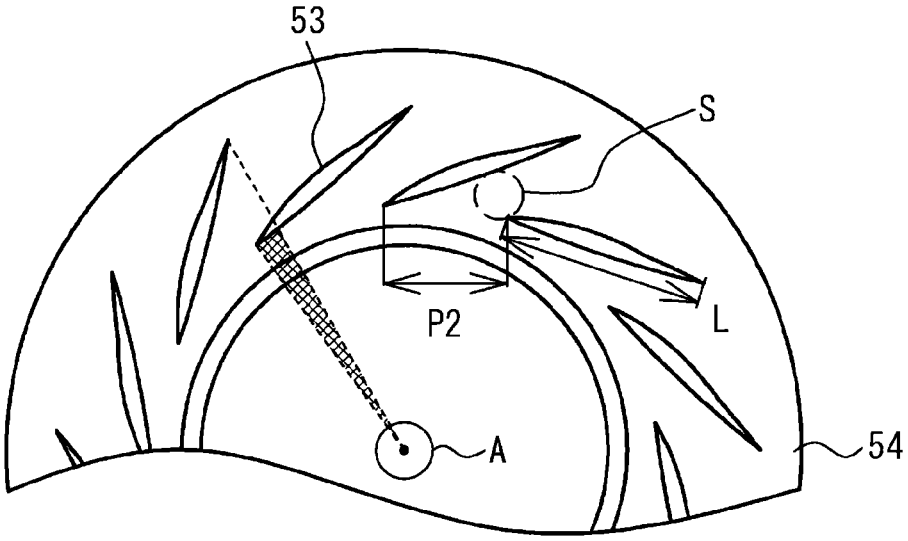

Now, a description is given of the vanes 53 provided on the diffuser plate 54. FIG. 3(*a*) is a front view of an exemplary diffuser plate of the compressor in accordance with Embodiment 1. FIG. 3(*b*) is a front view of an exemplary diffuser plate of the compressor in accordance with Comparative Example. In FIGS. 3(*a*) and 3(*b*), only the upper half of the diffuser plate 54 is illustrated. Dotted lines in the drawings are lines interconnecting the center axis A of the diffuser plate 54, or the center axis A of the compressor 11 and ends of the vanes 53. The center axis A is, for example, the center axis of the shaft 14 depicted in FIG. 1.

As shown by dotted lines in FIG. 3(*a*), in Embodiment 1, the adjacent vanes 53 do not overlap with each other when viewed from the center axis A of the diffuser plate 54, that is, the center axis A of the compressor 11. There is no throat formed between the adjacent vanes 53. Assuming that the distance between the adjacent vanes 53 (vane-to-vane pitch) is P1 and the length of the vanes 53 is L, the chord-pitch ratio of the vanes 53 L/P is equal to or smaller than 1.

As depicted in FIG. 3(*b*), Comparative Example is an example in which the number of vanes 53 is twice that of Embodiment 1 and the pitch between the adjacent vanes 53 is P2 that is smaller than P1. In this case, the chord-pitch ratio L/P2 is larger than the chord-pitch ratio L/P 1. As indicated by grating oblique lines in the drawing, the adjacent vanes 53 overlap with each other when viewed from the center axis A. Further, as indicated by a circle of a broken line, a throat S is formed between the vanes 53.

Figure 4:
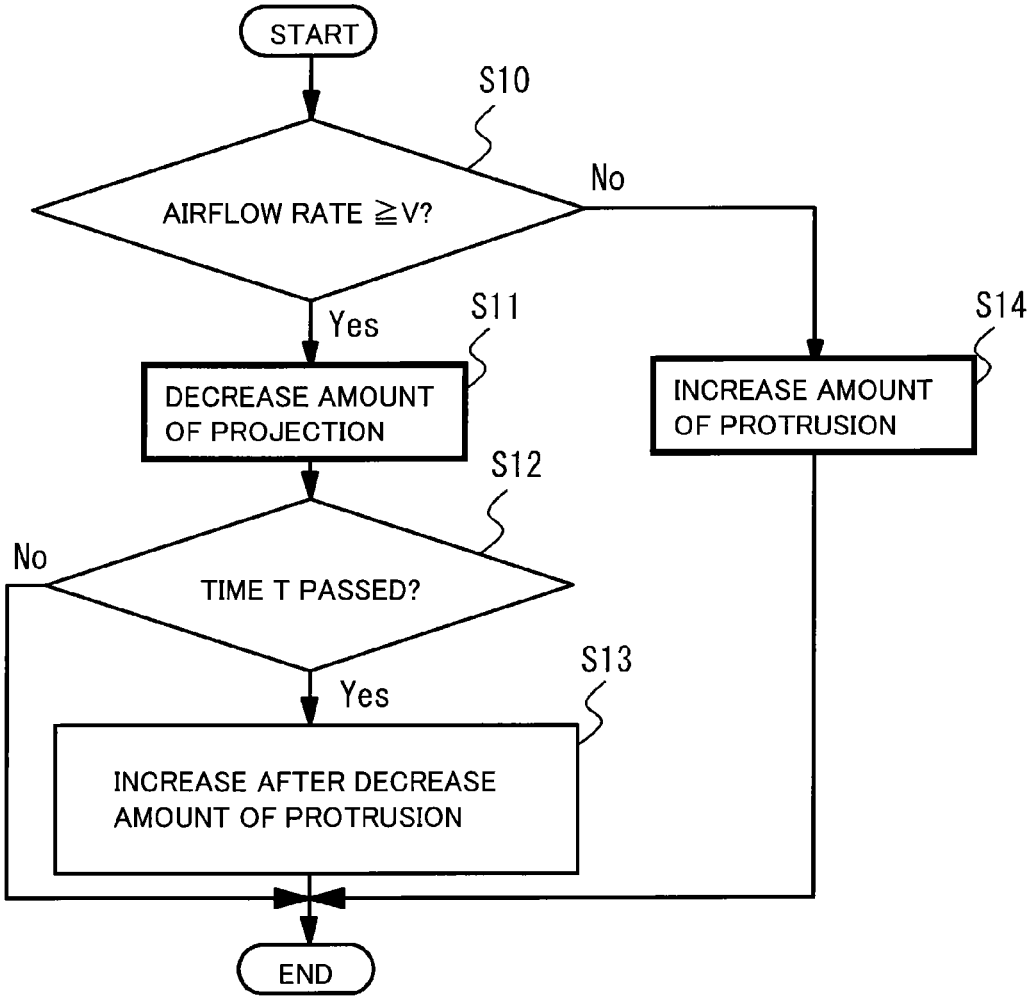
FIG. 4 is a flowchart of an exemplary control of the compressor in accordance with Embodiment 1.

Now, a description is given of a control of the compressor 11 in accordance with Embodiment 1. FIG. 4 is a flowchart of an exemplary control of the compressor in accordance with Embodiment 1.

As indicated in FIG. 4, the ECU 10 obtains the flow rate of air that passes through the diffuser flow path from the airflow meter 20, and determines whether the airflow rate is equal to or larger than a predetermined value V (step S10). In the case of Yes, or at so-called high airflow rates, the actuator 19 drives the diffuser plate 54 to decrease the amount of protrusion of the vanes 53 (step S11). In other words, the actuator 19 increases the distance between the vanes 53 and the shroud-side wall 17 to L1 (first distance L1). The distance L1 is the maximum distance between the vanes 53 and the hub-side wall plate 51 changed by the actuator 19 on the basis of the airflow rate.

After step S11, the ECU 10 determines whether the state in which the distance between the vanes 53 and the shroud-side wall 17 is L1 continues for the predetermined time T (step S12). In the case of No, the control is ended. In the case of Yes, the actuator 19 decreases the amount of protrusion of the vanes 53, and then increases the amount of protrusion up to the amount at step S11 (step S13). In other words, the actuator 19 makes the distance between the vanes 53 and the shroud-side wall 17 larger than L1, and then returns it to L1. After step S13, the control is ended.

In the case of No at step S10, or in the case of the so-called low airflow rates, the actuator 19 increases the amount of protrusion of the vanes 53 (step S14). In other words, the actuator 19 decreases the distance between the vanes 53 and the shroud-side wall 17. With the maximum amount of protrusion of the vanes 53, the vanes 53 are in contact with the shroud-side wall 17. After step S14, the control is ended. Steps S11 and S14 will be described later with reference to FIGS. 5(*a*) and 5(*b*). Step 13 will be described later with reference to FIGS. 9(*a*) and 9(*b*).

Figure 5A:
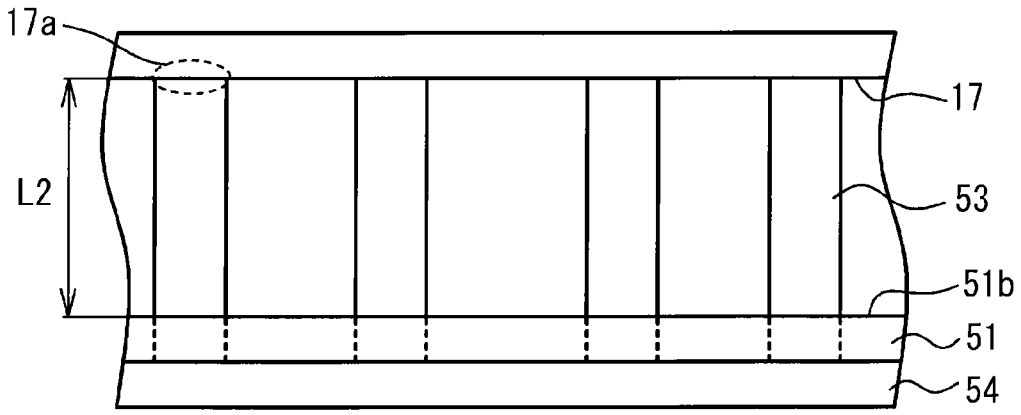
FIG. 5(*a*) is an explanatory diagram that schematically illustrates vanes at low airflow rates, and FIG. 5(*b*) is an explanatory diagram that schematically illustrates vanes at high airflow rates.
Figure 5B:
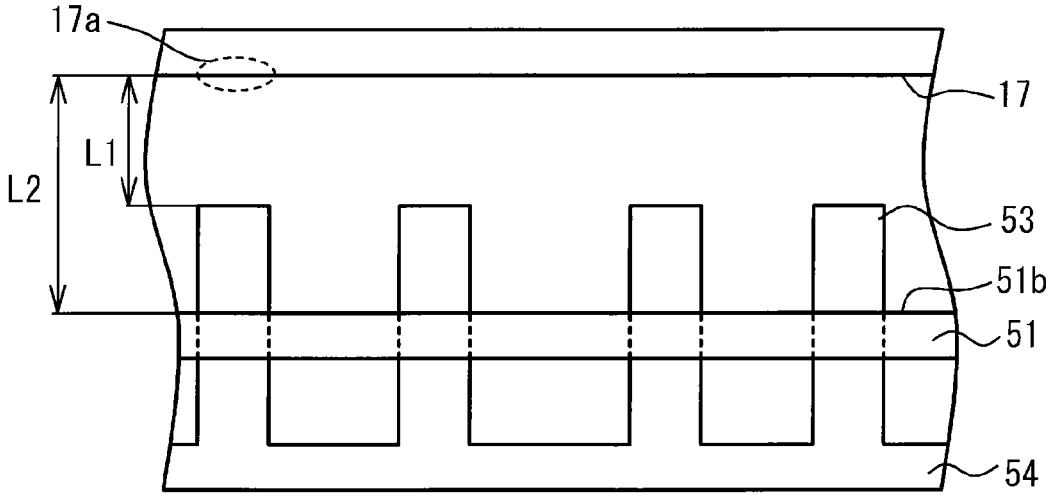

Now, a description is given of the protrusion states of the vanes 53. FIG. 5(*a*) is an explanation that schematically illustrates the vanes at low airflow rates. FIG. 5(*b*) is an explanation that schematically illustrates the vanes at high airflow rates. In FIGS. 5(*a*) and 5(*b*), the slits 51*a* are omitted. As has been described, the low airflow rates correspond to step S14 in FIG. 4. The high airflow rates correspond to step S11 in FIG. 4.

As depicted in FIG. 5(*a*), the distance between the hub-side wall 51*b* of the hub-side wall plate 51 and areas 17*a* that face the vanes 53 on the shroud-side wall 17 is L2. In Embodiment 1, since the shroud-side wall 17 has a flat surface, the distance L2 between the hub-side wall 51*b* and the areas 17*a* is approximately equal to the distance between the hub-side wall 51*b* and the shroud-side wall 17. At the low airflow rates, the vanes 53 are brought into contact with the shroud-side wall 17 (step S14 in FIG. 4). That is, the amount of protrusion of the vanes 53 is L2. It is thus possible to increase the compression efficiency of the compressor 11 at the low airflow rates.

As depicted in FIG. 5(*b*), at the high airflow rates, the vanes 53 protrude from the slits 51*a* and are distance L1 away from the shroud-side wall 17 (step S11 in FIG. 4). The distance L1 is smaller than the distance L2, and is equal to or smaller than half the distance L2, for example. As described above, even at the high airflow rates, the vanes 53 are not fully withdrawn in the slits 51*a* but remain in the diffuser flow path. In other words, the amount of protrusion of the vanes 53 does not become zero. At this time, the upper surfaces of the vanes 53 are located in proximity to the center of the diffuser flow path and closer to the hub-side wall 51*b*.

Figure 6:
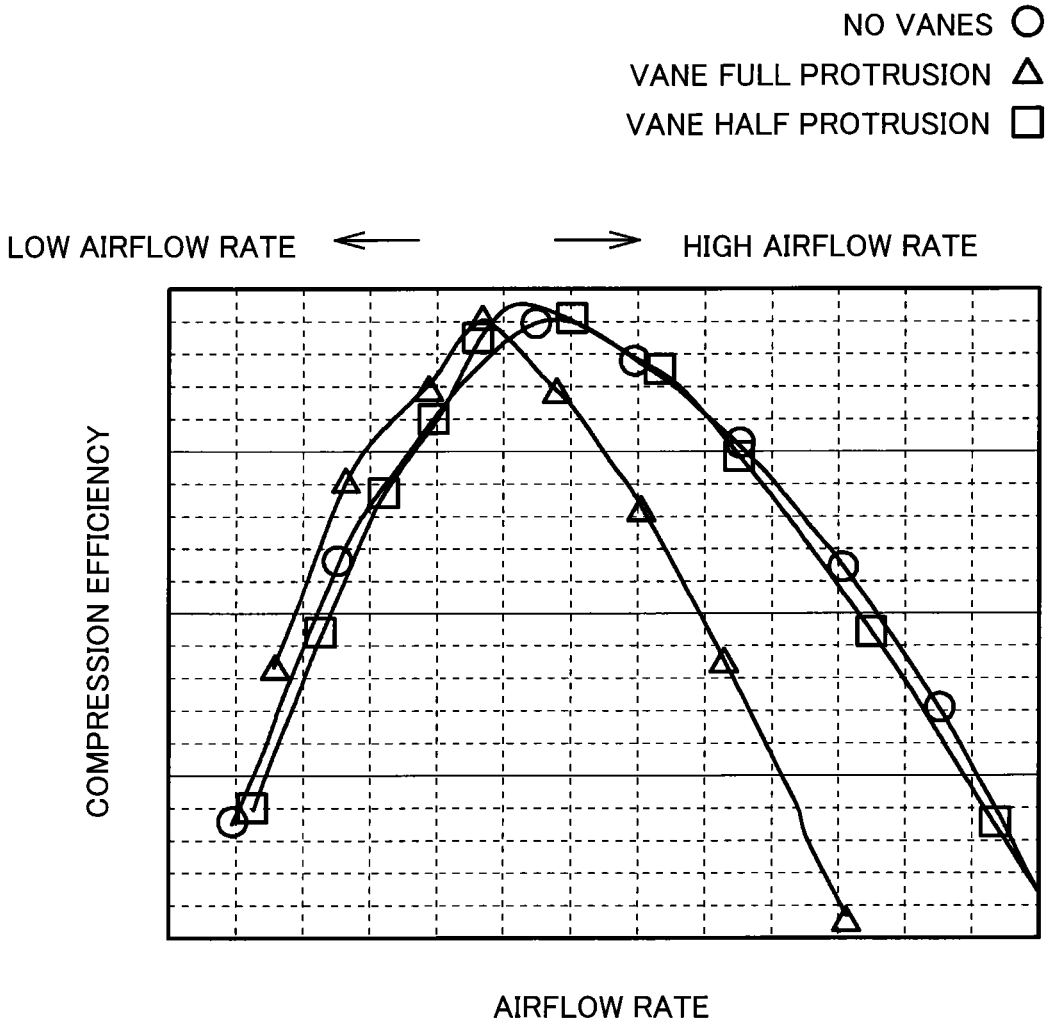
FIG. 6 is a graph that illustrates different compression efficiencies of the compressor and airflow rates for different amounts of protrusion of vanes.

Now, a description is described of the compression efficiency of the compressor 11 in accordance with Embodiment 1. FIG. 6 is a graph that illustrates different compression efficiencies of the compressor and airflow rates for different amounts of protrusion of vanes. The horizontal axis denotes the airflow rate, and the vertical axis denotes the compression efficiency. Among symbols in the drawing, circles indicate the compression efficiencies in a state in which the vanes 53 do not protrude into the diffuser flow path (NO VANES). Triangles indicate the compression efficiencies in another state in which the vanes 53 protrude over the full width and are in contact with the shroud-side wall 17 (VANE FULL PROTRUSION). The full protrusion of the vanes corresponds to the state in FIG. 5(*a*). Squares indicate the compression efficiencies in yet another state in which the vanes 53 protrude into the diffuser flow path and are not in contact with the shroud-side wall 17 (VANE HALF PROTRUSION). The half protrusion of vanes corresponds to the state in FIG. 5(*b*).

As depicted in FIG. 6, in the case of the full protrusion of the vanes, the compression efficiency of the compressor decreases as the airflow rate increases. On the contrary, in the case of no vanes or the half protrusion of the vanes, an almost constant compression efficiency of the compressor is available regardless of the airflow rates. As depicted on the left side of the drawing, when the airflow rate is low (in the case of the low airflow rates), the compression efficiency in the case of the full protrusion of the vanes is higher than that in the case of no vanes or the half protrusion of the vanes. In contrast, as depicted on the right side of the drawings, when the airflow rate is high (in the case of the high air flow rates), the compression efficiency in the case of no vanes or the half protrusion of the vanes is higher than that in the case of the full protrusion of the vanes. Therefore, at the low airflow rates, the full protrusion of the vanes is preferable, that is, it is preferable that the vanes 53 are caused to protrude so as to touch the shroud-side wall 17. At the high airflow rates, no vanes or the half protrusion of the vanes are preferable.

Figure 7A:
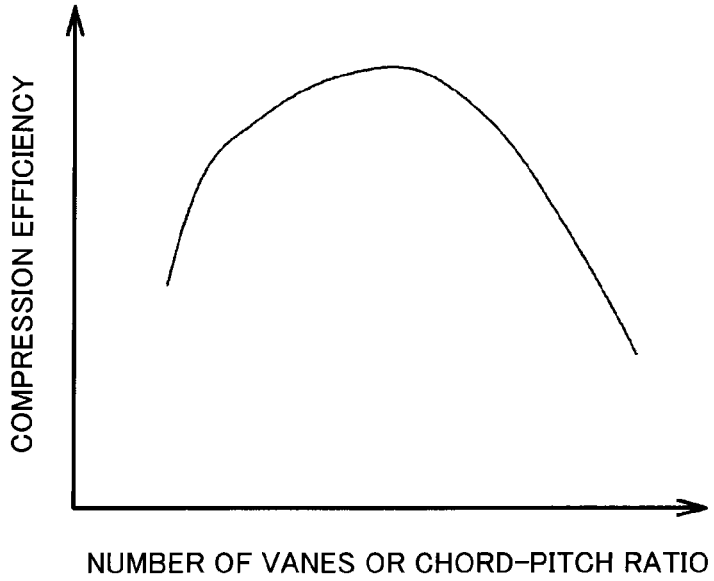
FIG. 7(*a*) is a graph that illustrates an exemplary compression efficiency at low airflow rates, and FIG. 7(*b*) is a graph that illustrates an exemplary relation between the amount of protrusion of the vanes and the compression efficiency of the compressor at high airflow rates.
Figure 7B:
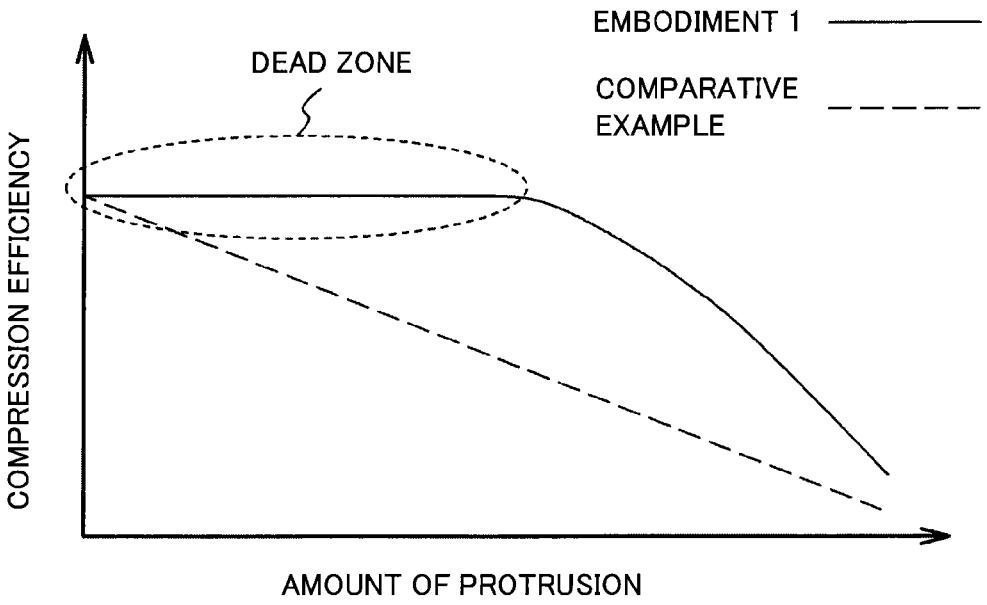

Now, a description is given of the compression efficiency at the low airflow rates. FIG. 7(*a*) is a graph that illustrates an exemplary compression efficiency at low airflow rates. The horizontal axis denotes the number of vanes 53 or the chord-pitch ratio thereof. The vertical axis denotes the compression efficiency. The state of the full protrusion of the vanes is now considered.

As illustrated in FIG. 7(*a*), when the number of the vanes 53 is small or the chord-pitch ratio of the vanes 53 is small, the flow of air passing through the diffuser flow path cannot be optimized, and therefore, the compression efficiency deteriorates. Further, as in the case of Comparative Example illustrated in FIG. 3(*b*), the compression efficiency also deteriorates when the number of the vanes 53 is large or the chord-pitch ratio thereof is large. This is because most of air hits the vanes 53 and loss of pressure is caused. In order to obtain a higher compression efficiency, it is desired to put the number of the vanes 53 or the chord-pitch ratio thereof in an appropriate range. For example, as has been depicted in FIGS. 2 and 3(*a*), a high compression efficiency is available by setting the number of the vanes 53 to six and setting the chord-pitch ratio equal to or smaller than 1. Next, the compression efficiency at the high airflow rates is described.

FIG. 7(*b*) is a graph that illustrates an exemplary relation between the amount of protrusion of the vanes and the compression efficiency of the compressor at high airflow rates. The horizontal axis denotes the amount of protrusion of the vanes 53. The vertical axis denotes the compression efficiency. A solid line represents the compression efficiency in Embodiment 1. A broken line represents the compression efficiency in Comparative Example.

As depicted in FIG. 7(*b*), in Comparative Example, the compression efficiency deteriorates as the amount of protrusion of the vanes 53 increases. Thus, in order to obtain a high compression efficiency, it is desired that the amount of protrusion of the vanes 53 is reduced to zero or close to zero. For this purpose, the moving distance of the vanes 53 is increased. In contrast, in Embodiment 1, the compression efficiency is almost constant within the range in which the amount of protrusion of the vanes 53 is equal to or smaller than the predetermined value. This corresponds to the fact in which the compression efficiency has little difference between no vanes and the half protrusion in FIG. 6. Further, the compression efficiency decreases as the amount of protrusion increases within the range in which the amount of protrusion is equal to or larger than the predetermined value. As surrounded by a dotted line in FIG. 7(*b*), a dead zone is defined as a range of the amount of protrusion of the vanes 53 in which the compression efficiency is almost constant regardless of the amount of protrusion.

Figure 8A:
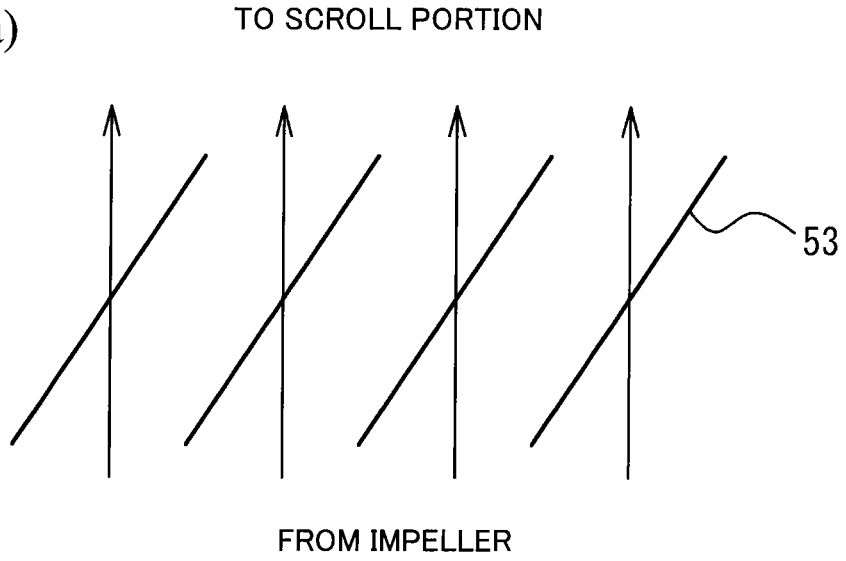
FIG. 8(*a*) is a schematic view of exemplary vanes in Comparative Example, and FIG. 8(*b*) is a schematic view of exemplary vanes in Embodiment 1.
Figure 8B:
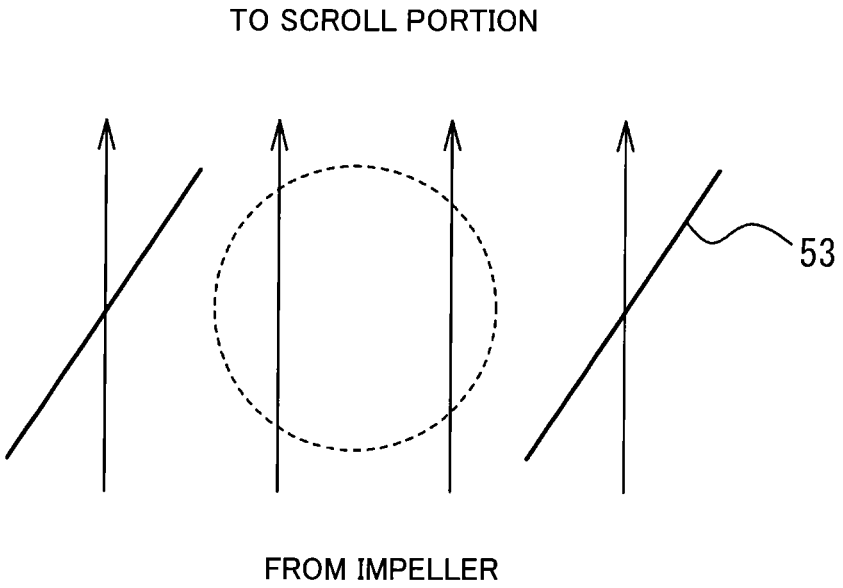

The mechanism of the presence of the dead zone is now described. FIG. 8(*a*) is a schematic view of exemplary vanes in Comparative Example, and FIG. 8(*b*) is a schematic view of exemplary vanes in Embodiment 1. FIGS. 8(*a*) and 8(*b*) are plan views of the vanes 53 that have the half protrusion. Arrows are flows of the fluid (air) traveling toward the scroll portion 15 side (see FIG. 1) from the impeller 13 side (see FIG. 1).

As depicted in FIG. 8(*a*), in Comparative Example, there are no gaps through which the fluid can go straight. Thus, the air flows while hitting the vanes 53, and large loss due to hitting is caused. Therefore, the compression efficiency is degraded when the vanes 53 are in the protrusion state.

As depicted in FIG. 8(*b*), in Embodiment 1, gaps exist between the vanes 53, and make it possible for some air to pass through the gaps (see a circle of dotted line).

In other words, some air is capable of flowing between the vanes 53 without hitting the vanes 53. Therefore, the compression efficiency can be highly maintained even in the case where the vanes 53 are in the protrusion state. In this case, the state of dead zone is realized as depicted in FIG. 7(*b*).

According to the compressor 11 of Embodiment 1, as illustrated in FIG. 3(*a*), the vanes 53 adjacent to each other when viewed from the center of the compressor 11 (center axis A) do not overlap with each other. No throat is formed between the adjacent vanes 53. Therefore, the dead zone depicted in FIG. 7(*b*) exists at the high airflow rates. Even in the case where the actuator 19 sets the distance between the vanes 53 and the shroud-side wall 17 to the maximum L1 in accordance with the airflow rate as indicated at step S11 in FIG. 4 and in FIG. 5(*b*), L1 is smaller than the distance L2 between the hub-side wall plate 51 and the areas 17*a* of the shroud-side wall 17 that faces the vanes 53. It is therefore possible to maintain the high compression efficiency and reduce the movement distance of the vanes 53.

When the movement distance of the vanes 53 is small, power consumed in the actuator 19 is reduced. This makes it possible to use the solenoid type actuator instead of the external diaphragm type actuator and to downsize the actuator 19. As described above, Embodiment 1 is capable of downsizing the compressor 11 and reducing the power consumption.

In order to effectively downsize the compressor 11 and reduce the power consumption, it is preferable that the actuator 19 is of solenoid type. The actuator 19 may be an electric actuator other than the solenoid type actuator. The electric actuator converts electric energy into mechanical force, which changes the amount of protrusion of the vanes 53.

The vanes 53 may be arranged so that the adjacent vanes 53 overlap with each other when viewed from the center and throats are formed. The vanes 53 may also be arranged so that no throats are formed and the adjacent vanes 53 overlap with each other when viewed from the center. Further, the chord-pitch ratio may be set larger than 1. However, in order to effectively obtain the high compression efficiency, the vanes 53 are preferably arranged so that the adjacent vanes 53 do not overlap with each other when viewed from the center and no throats are formed. Further, the chord-pitch ratio is preferably equal to or smaller than 1. The chord-pitch ratio may be equal to or smaller than 0.9 or 0.8, for example. The number of the vanes 53 is not limited to six but may be five or seven, for example. As described above, the vane-to-vane pitch P1, the number of the vanes 53 and so on are changeable.

As has been described at steps S10 and S14 in FIG. 4, at the low airflow rates, the actuator 19 makes the distance between the vanes 53 and the shroud-side wall 17 smaller than L1. In contrast, as has been described at steps S10 and S11 in FIG. 4, at the high airflow rates, the actuator 19 increases the distance between the vanes 53 and the shroud-side wall 17 to L1. It is thus possible to obtain the high compression efficiencies at both the low and high airflow rates.

As depicted in FIG. 5(*b*), at the high airflow rates, the vanes 53 are maintained in the state in which the vanes 53 protrude from the hub-side wall 51*b* into the diffuser flow path. The speed of the fluid (air) that passes through the diffuser flow path in proximity to the center of the diffuser flow path is higher than that on the wall (the shroud-side wall 17 or the hub-side wall 51*b*) side. Since the upper surfaces of the vanes 53 are located in proximity to the center of the diffuser flow path, deposits are hardly put on the upper surfaces of the vanes 53 or in the vicinity thereof. Thus, the operation of the vanes 53 is smoothened.

However, there is a possibility that the deposits may be put on portions of the vanes 53 close to the hub-side wall 51*b*. Specifically, when a certain time passes while the amount of protrusion of the vanes 53 is kept constant, the deposits may be put.

For example, a case is considered where the state in which the distance between the vanes 53 and the shroud-side wall 17 is L1 is kept for time T. This corresponds to the case of Yes at step S12 in FIG. 4.

Figure 9A:
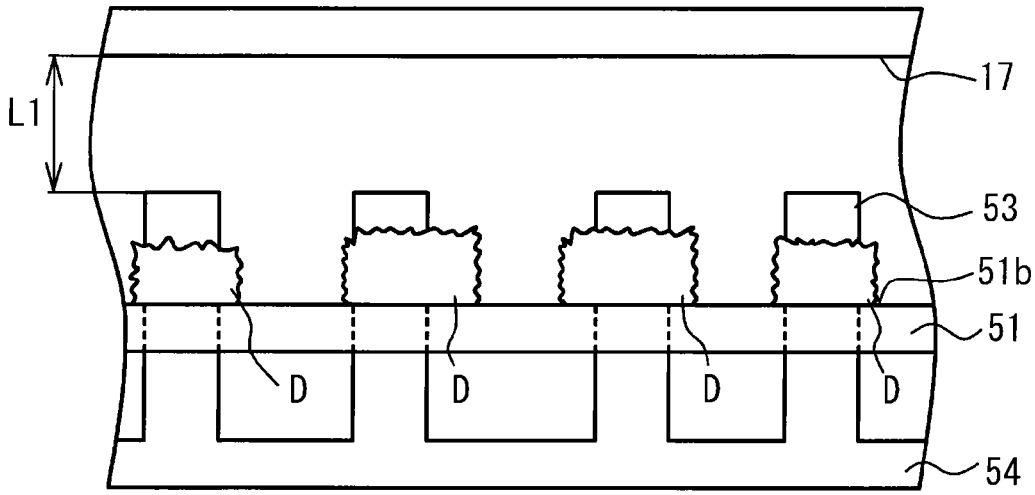
FIG. 9(*a*) is an explanatory diagram that schematically illustrates vanes on which deposits are put, and FIG. 9(*b*) is an explanatory diagram that schematically illustrates an operation of the vanes for removal of the deposits.
Figure 9B:
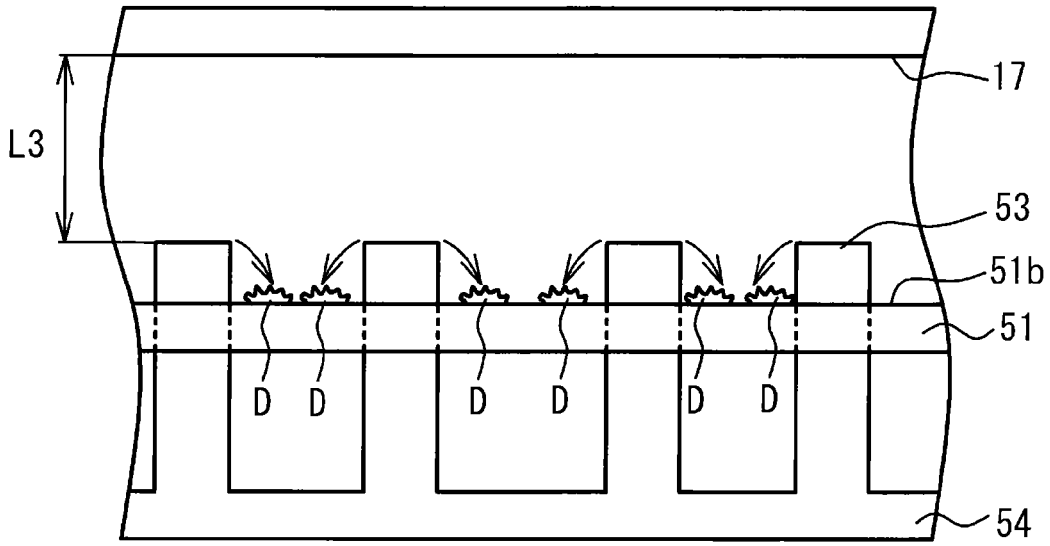

FIG. 9(*a*) is an explanatory diagram that schematically illustrates the vanes 53 on which deposits are put, and FIG. 9(*b*) is an explanatory diagram that schematically illustrates an operation of the vanes 53 for removal of the deposits. As illustrated in FIG. 9(*a*), deposits D may be put on lower portions of the vanes 53. If the deposits D are firmly fixed, the operation of the vanes 53 may be difficult.

As illustrated in FIG. 9(*b*), when the state in which the distance between the vanes 53 and the shroud-side wall 17 is L1 is kept for the predetermined time T (Yes at step S12 in FIG. 4), the actuator 19 moves the vanes 53 downwards, and returns the vanes 53 to the original position (step S13 in FIG. 4). In other words, the actuator 19 sets the distance between the vanes 53 and the shroud-side wall 17 to L3 that is larger than L1, and then returns the distance to L1. This removes the deposits D and smoothens the operation of the vanes 53. The time T may be set to an arbitrary time as much as the deposits can be removed before the deposits are firmly fixed.

In the above operation, the actuator 19 may move the vanes 53 upward before returning them to the original position. In this manner, the actuator 19 changes the distance between the vanes 53 and the shroud-side wall 17 and then returns the distance to L1. However, as illustrated in FIG. 7(*b*), when the vanes 53 have a large amount of protrusion, the vanes 53 leave the dead zone, and the compression efficiency may be degraded. In contrast, even when the vanes 53 have a small amount of protrusion, the vanes 53 exist in the dead zone, and the compression efficiency is kept high. It is therefore preferable that the actuator 19 sets the distance between the vanes 53 and the shroud-side wall 17 larger than L1, and then returns the distance to L1.

Although Embodiment 1 is structured to have the vanes 53 that protrude from the hub-side wall 51*b* toward the shroud-side wall 17, the compressor 11 may have another structure. For example, the vanes 53 may be structured to protrude from the shroud-side wall 17 toward the hub-side wall 51*b*.

Embodiment 2

Figure 10A:
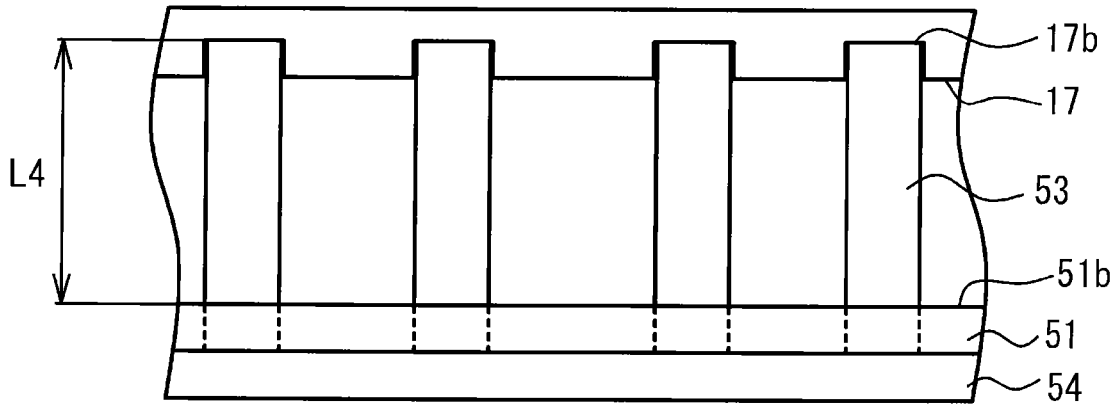
FIGS. 10(*a*) and 10(*b*) are explanatory diagrams that schematically illustrate vanes of a compressor in accordance with Embodiment 2.
Figure 10B:
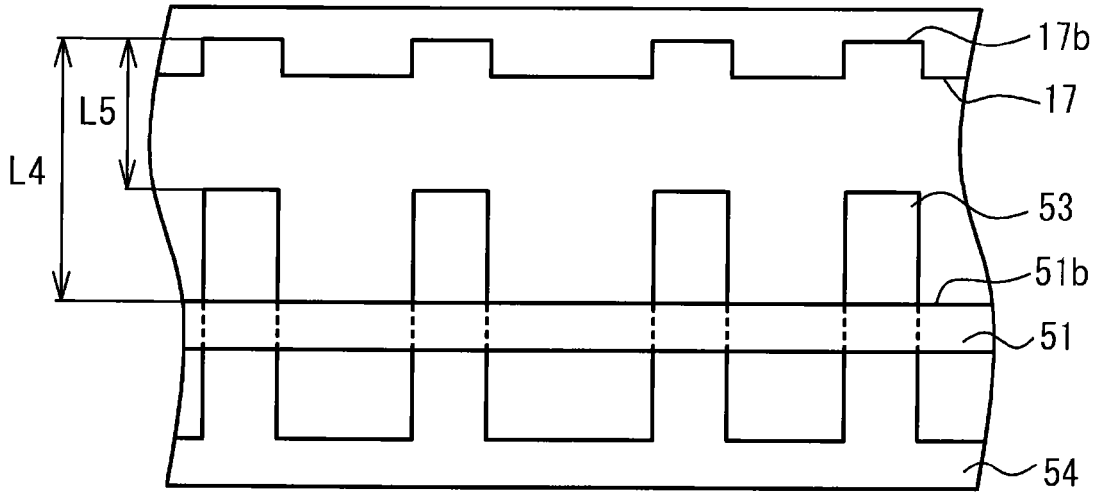

FIGS. 10(*a*) and 10(*b*) are explanatory diagrams that schematically illustrate vanes of a compressor in accordance with Embodiment 2. A description of the structures that have been described with reference to FIGS. 1 through 3(*a*) are omitted.

As depicted in FIGS. 10(*a*) and 10(*b*), cavities 17*b* are formed in areas of the shroud-side wall 17 that face the vanes 53. The distance between the hub-side wall 51*b* of the hub-side wall plate 51 and the bottom surfaces of the cavities 17*b* is L4.

As depicted in FIG. 10(*a*), at the low airflow rates, the vanes 53 are in contact with the bottom surfaces of the cavities 17*b*. As depicted in FIG. 10(*b*), at the high airflow rates, the vanes 53 protrude from the slits 51*a* and are distance L5 away from the bottom surfaces of the cavities 17*b*. The distance L5 is smaller than the distance L4, and may be equal to or smaller than half the distance L4, for example. In other words, the distance L5 between the vanes 53 and the shroud-side wall 17 is smaller than the distance L4 between the hub-side wall 51*b* and the areas of the shroud-side wall 17 that face the vanes 53. The control of the compressor 11 in accordance with Embodiment 2 is the same as that depicted in FIG. 4, and a description thereof is omitted. According to Embodiment 2, downsizing and reduction in consumption power are possible as in the case of Embodiment 1. Further, the compression efficiency can be kept high. The vanes 53 may be designed to protrude from the shroud-side wall 17 toward the hub-side wall 51*b*, and the cavities may be provided in areas of the hub-side wall 51*b* that face the vanes 53.

Although some embodiments of the present invention have been described in detail, the present invention is not limited to these specific embodiments but may be variously changed or varied within the scope of the claimed invention.

DESCRIPTION OF REFERENCE NUMERALS

10 ECU
11 compressor
16 diffuser portion
17 shroud-side wall
17*a* area
17*b* cavity
19 actuator
50 slide type vane mechanism
51 hub-side wall plate
51*b* hub-side wall
53 vane

The invention claimed is:

1. A centrifugal compressor comprising:

a first diffuser wall;

a second diffuser wall that faces the first diffuser wall and forms a diffuser flow path between the first diffuser wall and the second diffuser wall;

guide blades capable of protruding from the first diffuser wall into the diffuser flow path; and a change unit configured to change a distance between the guide blades and the second diffuser wall in accordance with an airflow rate of the diffuser flow path, wherein the centrifugal compressor is equipped with at least one of a structure in which adjacent ones of the guide blades do not overlap with each other when viewed from a center axis of the centrifugal compressor and a structure in which a throat is not formed between adjacent ones of the guide blades;

a distance between the guide blades and the second diffuser wall is smaller than a distance between the first diffuser wall and areas of the second diffuser walls that face the guide blades when the change unit maximizes the distance between the guide blades and the second diffuser wall;

the change unit sets the distance between the guide blades and the second diffuser wall to a first distance if the airflow rate of the diffuser flow path is equal to or larger than a predetermined value;

the change unit sets the distance between the guide blades and the second diffuser wall to a distance smaller than the first distance if the airflow rate of the diffuser flow path is smaller than the predetermined value; and the change unit sets the distance between the guide blades and the second diffuser wall larger than the first distance, and then returns the distance to the first distance, if a state in which the airflow rate is equal to or larger than the predetermined value continues for a predetermined time.

2. The centrifugal compressor according to claim 1, wherein a chord-pitch ratio of the guide blades is equal to or smaller than 1.

3. The centrifugal compressor according to claim 1, wherein the change unit is an electric actuator.

4. The centrifugal compressor according to claim 3, wherein the change unit is a solenoid type actuator.

* * * * *